US008302585B2

(12) United States Patent
FitzGerald

(10) Patent No.: US 8,302,585 B2
(45) Date of Patent: Nov. 6, 2012

(54) SNOWBALL FORMING AND LAUNCHING DEVICE

(75) Inventor: David FitzGerald, Hayward, CA (US)

(73) Assignee: Wham-O Inc. CA (US)

( * ) Notice: Subject to any disclaimer, the term of this patent is extended or adjusted under 35 U.S.C. 154(b) by 267 days.

(21) Appl. No.: 12/698,818

(22) Filed: Feb. 2, 2010

(65) Prior Publication Data

US 2010/0242938 A1 Sep. 30, 2010

Related U.S. Application Data

(60) Provisional application No. 61/149,295, filed on Feb. 2, 2009.

(51) Int. Cl.
*F41B 3/00* (2006.01)

(52) U.S. Cl. ..... 124/5

(58) Field of Classification Search ..... 124/5
See application file for complete search history.

(56) References Cited

U.S. PATENT DOCUMENTS 3,901,208 A * 8/1975 Laporte et al. ..... 124/5
4,548,413 A * 10/1985 David ..... 473/173
5,000,153 A * 3/1991 Zimmerman et al. ..... 124/5
7,128,556 B2 * 10/2006 Wessells et al. ..... 425/276
D567,602 S * 4/2008 Choy et al. ..... D8/14
7,815,429 B1 * 10/2010 Clark, Jr. ..... 425/276

* cited by examiner

*Primary Examiner* — John Ricci

(57) ABSTRACT

A combined snowball forming and launching device is described. The device includes a portion for gathering snow, a mechanism for compacting the snow, and a handle to swing the scoop and launch a snowball. In one embodiment the compacting mechanism is a press at one end of an elongated portion. In another embodiment, the elongated portion is a curved channel that may be used for gathering and launching a snowball. A method for forming and launching snowballs is also described.

16 Claims, 8 Drawing Sheets

6
111
113
110
105
115
113
103
C
A
6
104
5
5
100
101
102

4
103
113
105
110
113
115
111
109
101
102
4
W

SNOWBALL FORMING AND LAUNCHING DEVICE

CROSS-REFERENCE TO RELATED APPLICATIONS

This application claims the benefit of U.S. Provisional Application No. 61/149,295, filed Feb. 2, 2009, the entire contents of which are hereby incorporated by reference herein and made part of this specification.

BACKGROUND OF THE INVENTION

1. Field of the Invention

The present invention generally relates to a device and method for use with snow, and more particularly to a device and method for forming and launching a snowball.

2. Discussion of the Background

As anyone who has participated in a snowball fight knows, it takes time to gather and form snowballs, and the speed at which one can throw is limited by the length of one's arm There exists a need in the art for a device that facilitates the forming and throwing of snowballs. Such an apparatus should be easy to use, small and lightweight, and be rugged. Other features of the apparatus may include: the rapid formation of snowballs and an increase in throwing speed.

BRIEF SUMMARY OF THE INVENTION

The present invention overcomes the disadvantages of prior art by providing an integral snowball forming and throwing device.

One embodiment provides a device including a portion for gathering snow and a mechanism to compact the snow into a snowball. Another embodiment provides a device having a handle to permit the throwing of formed snowballs from the device.

One embodiment provides a device for manipulating snow. The device includes a handle, a mold, and an elongated portion having a proximal portion near an opening of said mold, and a distal portion.

Yet another embodiment provides a device for manipulating snow. The device includes a handle, a mold hinged to the handle, and an elongated portion having a proximal portion near an opening of the mold, and a distal portion.

Another embodiment provides a method of throwing a snowball using a device having an elongated portion and a mold. The method includes scooping snow with the elongated portion, forming a snowball in the mold, and swinging the elongated portion to launch the snowball.

These features together with the various ancillary provisions and features which will become apparent to those skilled in the art from the following detailed description, are attained by the snowball forming and/or launching device and method of the present invention, preferred embodiments thereof being shown with reference to the accompanying drawings, by way of example only, wherein:

BRIEF DESCRIPTION OF THE SEVERAL VIEWS OF THE DRAWING

FIG. 8A illustrates the shoveling of snow into the device; FIG. 8B illustrates scooping snow into the device, FIGS. 8C and 8D illustrate consecutive positions of the device during the forming a snowball, and FIGS. 8E, 8F, and 8G illustrate consecutive positions of the device during the launching of a snowball.

Reference symbols and/or labels are used in the Figures to indicate certain components, aspects or features shown therein, with reference symbols or labels common to more than one Figure indicating like components, aspects or features shown therein.

DETAILED DESCRIPTION OF THE INVENTION

As described herein, devices and methods are described to gather a material, to form masses of material, and/or launch a mass of material. For example and without limitation, the devices and methods will be described for use in snow. Thus the device may be used to gather up loose snow, form a snowball, and/or launch a snowball.

Figure 1:
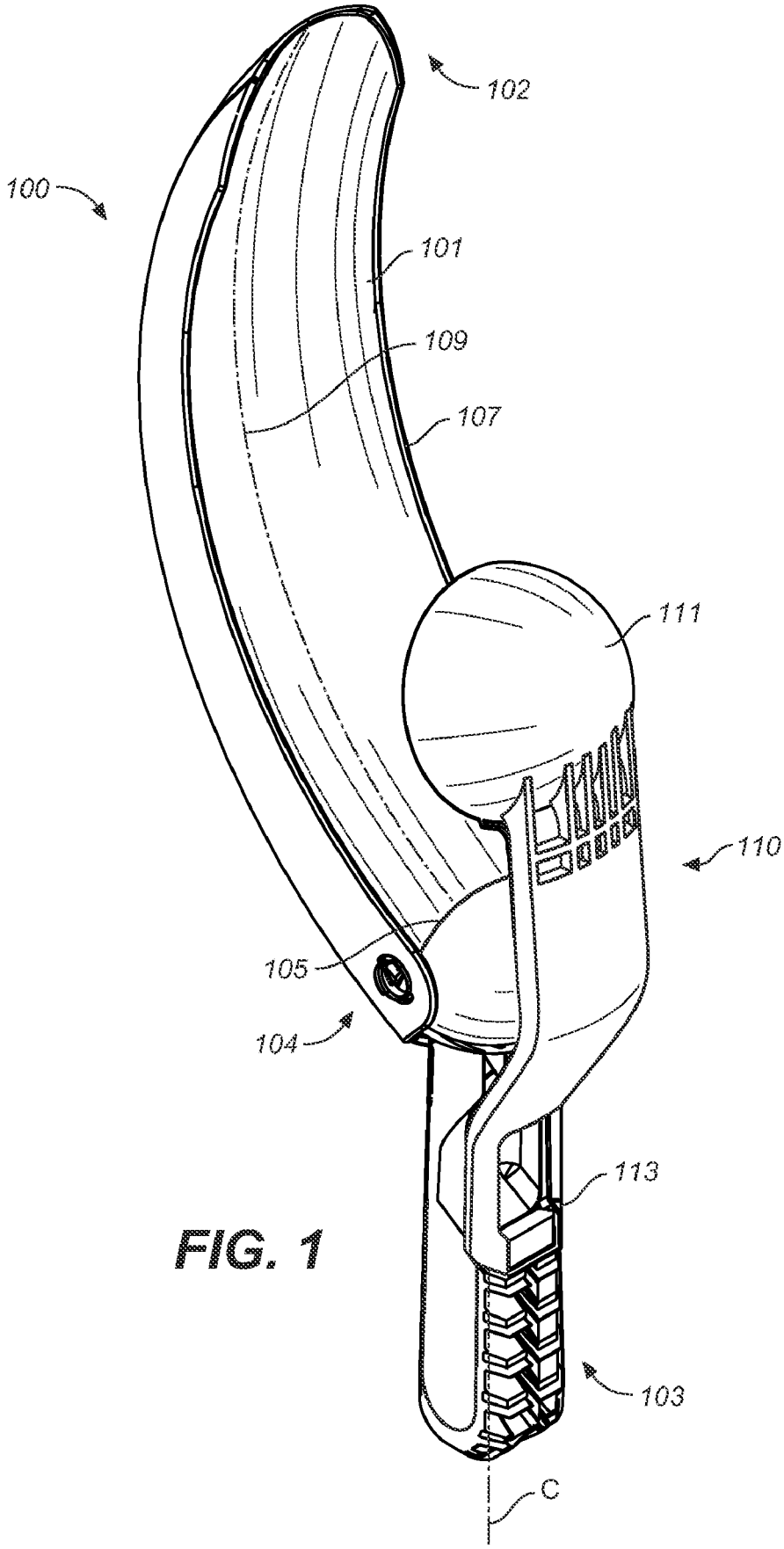
FIG. 1 is a perspective view of a first embodiment snowball forming and launching device.
Figure 2:
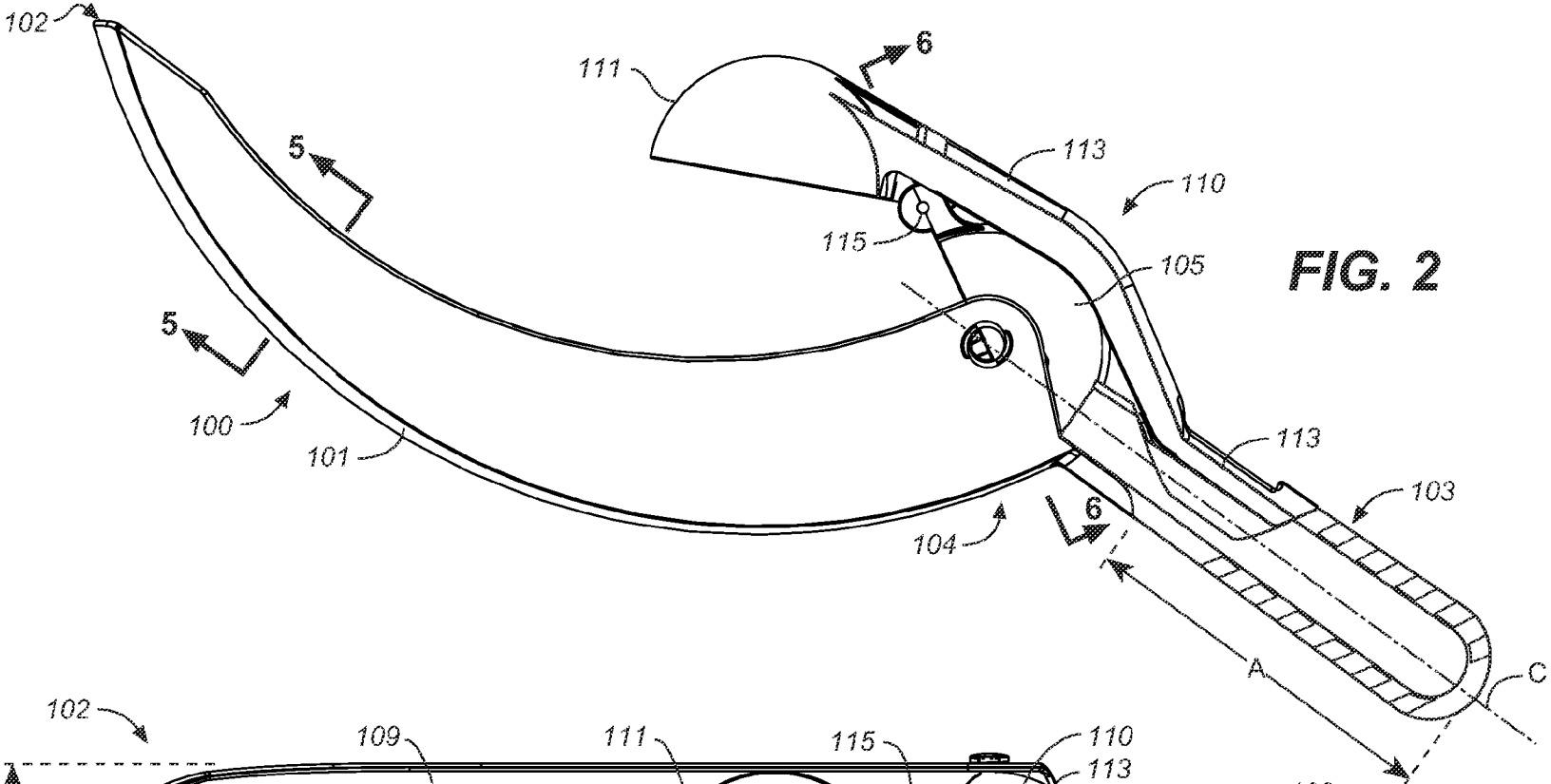
FIG. 2 is a side view of the embodiment of FIG. 1.
Figure 3:
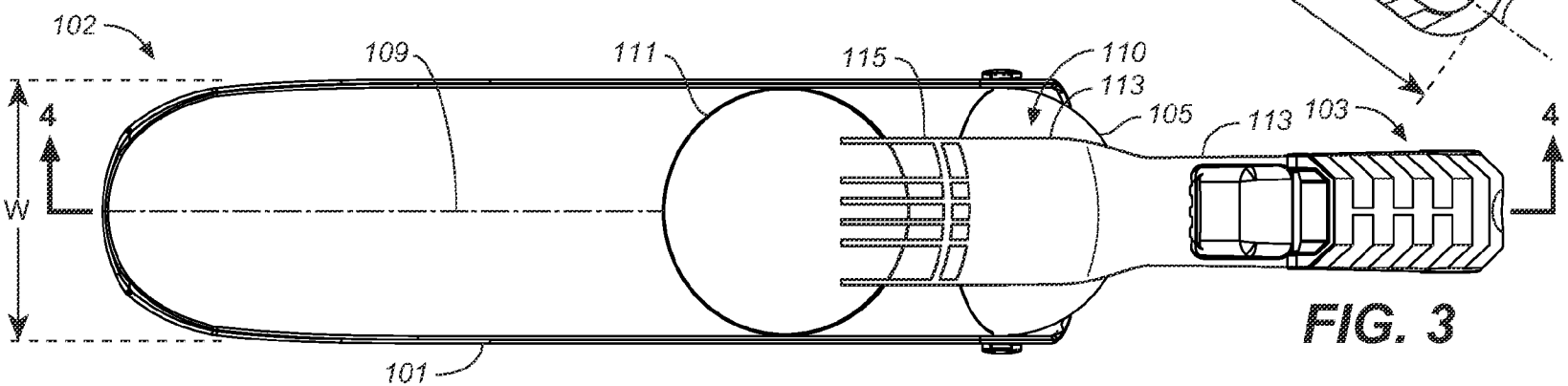
FIG. 3 is a top view of the embodiment of FIG. 1.

A first embodiment device 100 is illustrated in the perspective view of FIG. 1, side view of FIG. 2, and top view of FIG. 3. Device 100 is shown in more detail in the sectional longitudinal view 4-4 of FIG. 4, and in the first transverse sectional view 5-5 of FIG. 5 and the second transverse sectional view 6-6 of FIG. 6.

Device 100 includes a handle 103, a channel 101, and a first mold 105. Handle 103 has a length A along a longitudinal axis C and has a shape facilities being held by a user, and may be sized, for example, for use by a child or by an adult. Channel 101 extends away from handle 103 from a proximal end 104 to a distal end 102. First mold 105 is adjacent to proximal end 104. The term "channel" as used herein is a general term that denotes an elongated portion of device 100 that may permit material to be provided to and/or from mold 105.

Device 100 further includes a portion 110 that is operably attached to mold 105 and which includes a second mold 111 and a lever 113. Portion 110 may be moved such that molds 105 and 111 are two halves of a press. Thus, for example, FIGS. 2, 3, 4, and 6 show a hinge 115 that joins molds 105 and 111, that mold 105 is joined to handle 103, and that mold 111 is joined to lever 113. The axis of hinge 115 is generally perpendicular to longitudinal axis C, and permits first mold 105 and second mold 111 to rotate in an axis transverse to axis C by moving lever 113 relative to handle 103.

In the embodiment of FIGS. 1-6, channel 101 is shown as having a proximal end 104 near cavity 401 of mold 105, and an open, distal end 102. Channel 101 further has edges 107 that meet at distal end 102 and bottom 109 that extends a length B from a distal end 102 to a proximal end 104.

Figure 4:
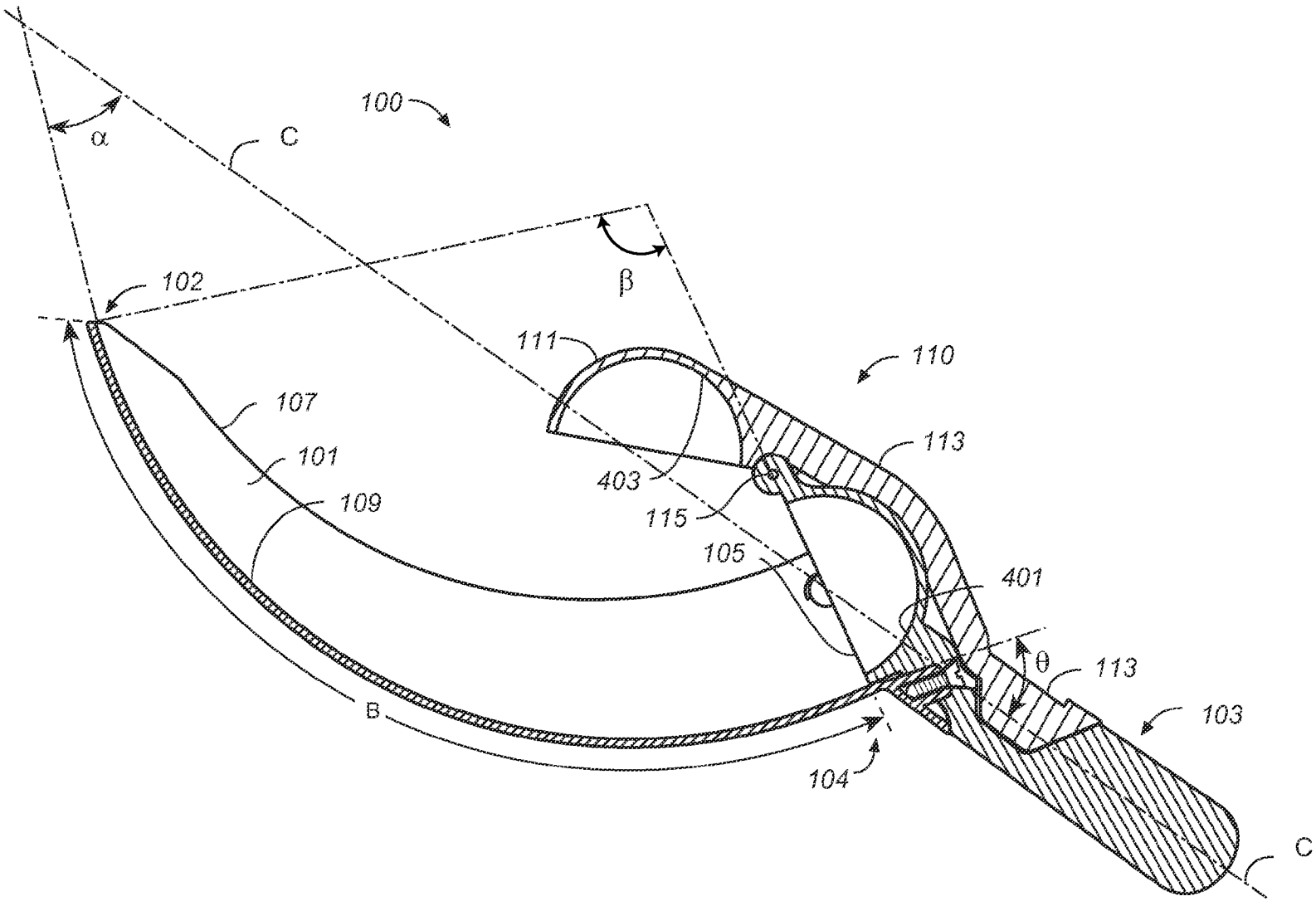
FIG. 4 is a sectional longitudinal view 4-4 of FIG. 2.
Figure 5:
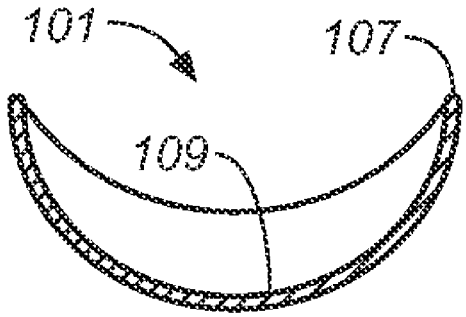
FIG. 5 is a first transverse sectional view 5-5 of FIG. 3.
Figure 6:
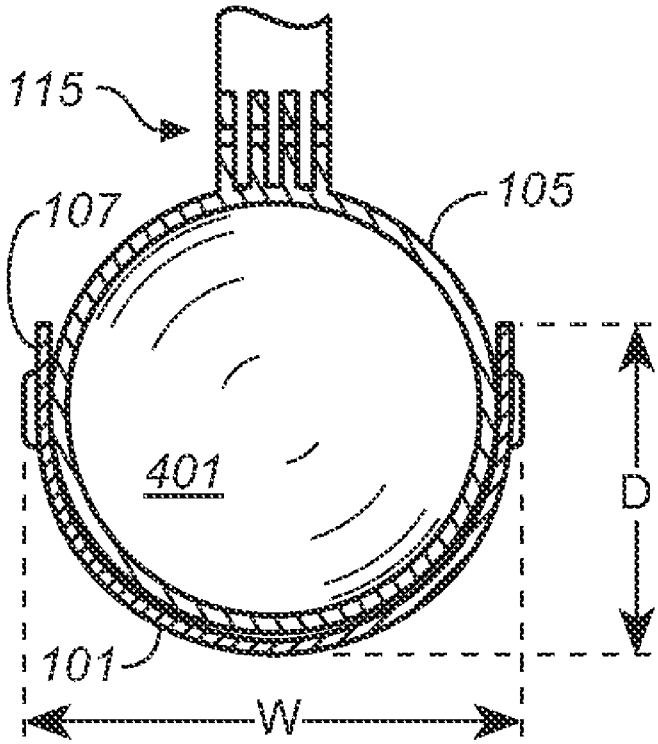
FIG. 6 is a second transverse sectional view 6-6 of FIG. 3.

FIGS. 3, 5 and 6 show the curvature of channel 101 perpendicular to bottom 109. Channel 101 has a width W that is slightly greater than the size of cavities 401 and 403, and a depth D of zero at distal end 102 to a depth at proximal end 104. In one embodiment, depth D at distal end 102 may be from one half to twice the dimension of an object which may be pressed within cavities 401 and 403. As an example, which is not meant to limit the scope of the present invention, if cavities 401 and 403 form a sphere, then depth D at proximal end 104 may be on the order of one half of the diameter of the sphere. As shown in FIG. 4, Channel 101 is also curved longitudinally, with bottom 109 curving along the length B, meeting axis C at an angle that varies along the length B.

In one embodiment, the length A is from approximately 100 mm to approximately 250 mm. In another embodiment, the length B is from 200 mm to 700 mm, or approximately from 250 mm to 350 mm, or is approximately 300 mm. In yet another embodiment, the width W is approximately twice the depth D, and D is from approximately 15 mm to approximately 70 mm. As shown in FIG. 4, bottom 109 at proximal end 104 forms an angle $\Theta$ with axis C which may be from approximately 45 degrees to approximately 60 degrees, or from approximately 55 degrees to approximately 70 degrees, or is approximately 60 degrees Bottom 109 at distal end 102 forms an angle $\alpha$ with axis C which may be from approximately 35 degrees to approximately 60 degrees, from approximately 40 degrees to approximately 55 degrees, or is approximately 55 degrees. In one embodiment, bottom 109 is an arc having an included angle $\beta$ of from 100 degrees to 115 degrees.

In alternative embodiments, channel 101 may be partially closed or tubular, may be flat, or may be straight.

Molds 105 and 111 are movable, permitting device 100 to be configured between two extreme configurations. A first configuration is shown in FIGS. 1-6, with molds 105 and 111 rotated away from each other. A second configuration has molds 105 and 111 forming a closed cavity, as discussed subsequently with regards to FIGS. 8C and 8D. As is further shown in FIG. 4, mold 104 has a cavity 401 and mold 111 has a cavity 403. Cavities 401 and 403, when pressed together, form a generally concave enclosure which may be used to press an object, which may, for example and without limitation, be spherical.

In one embodiment, cavities 401 and 403 are each hemispherical in shape. In one embodiment, the complete mold is approximately spherical with a diameter of from approximately 30 mm to approximately 130 mm, from approximately 50 mm to approximately 75 mm, or is approximately 130 mm, In addition, one or both of cavities 401 and 403 may include raised or lowered portions (not shown) which may be used to imprint a name and/or logo onto items formed in the mold.

Figure 7:
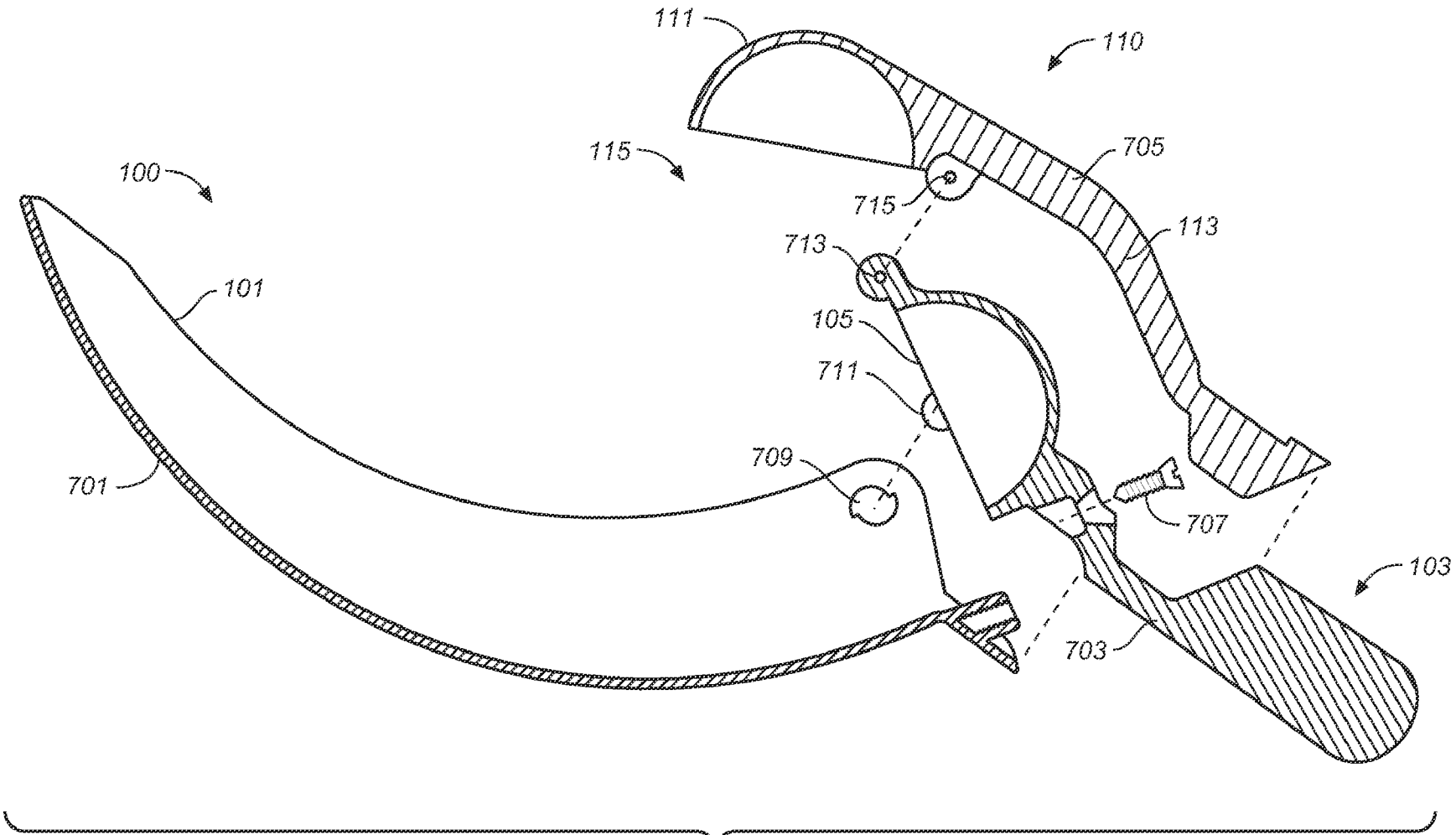
FIG. 7 is an exploded side view of a one embodiment of the device of FIG. 1.

FIG. 7 is an exploded side view of the device of FIG. 1. The device of FIG. 7 is illustrative of an embodiment, and is not meant to limit the scope of the present invention.

As shown in FIG. 7, device 100 may include a first part 701, a second part 703, and a third part 705. First part 701 includes channel 101 and a pair of notches 709. Second part 703 includes a pair of protrusions 711, a passageway 713, handle 103 and first mold 105. Third part 705 includes a passageway 715, mold handle 113 and second mold 111.

First part 701 and second part 703 are joined together by placing each protrusion 711 in a notch 709, and by securing the parts using a screw 707. Third part 705 is joined to second part 703 by aligning passageways 713 and 717 and placing a hinge pin (not shown) through the aligned passageways, thus forming hinge 115.

In one embodiment, parts 701, 703, and 705 are formed from plastic by injection molding. Examples of materials for parts 701, 703, and 705 include, but are not limited to, one or more of a polypropylene, high-density polyethylene, low-density polyethylene, polycarbonate, polyethylene terephthalate, and/or polyvinyl chloride. In addition, portion 701 may be formed from compression molded EVA foam, and portion 703 and/or 705 may be formed from nylon.

FIGS. 8A-8G are illustrative of the uses of device 100 as the gathering of snow, the forming of a snowball, and the launching of a snowball. In general, device 100 may be used, for example, for A) gathering snow, B) forming a snowball, or C) launching a snowball. In addition, device 100 may be used to form two or more of these steps, such as, for example: A) gathering snow followed by B) forming a snowball; B) forming a snowball followed by C) launching a snowball; or A) gathering snow followed by B) forming a snowball followed by C) launching a snowball.

Figure 8A:
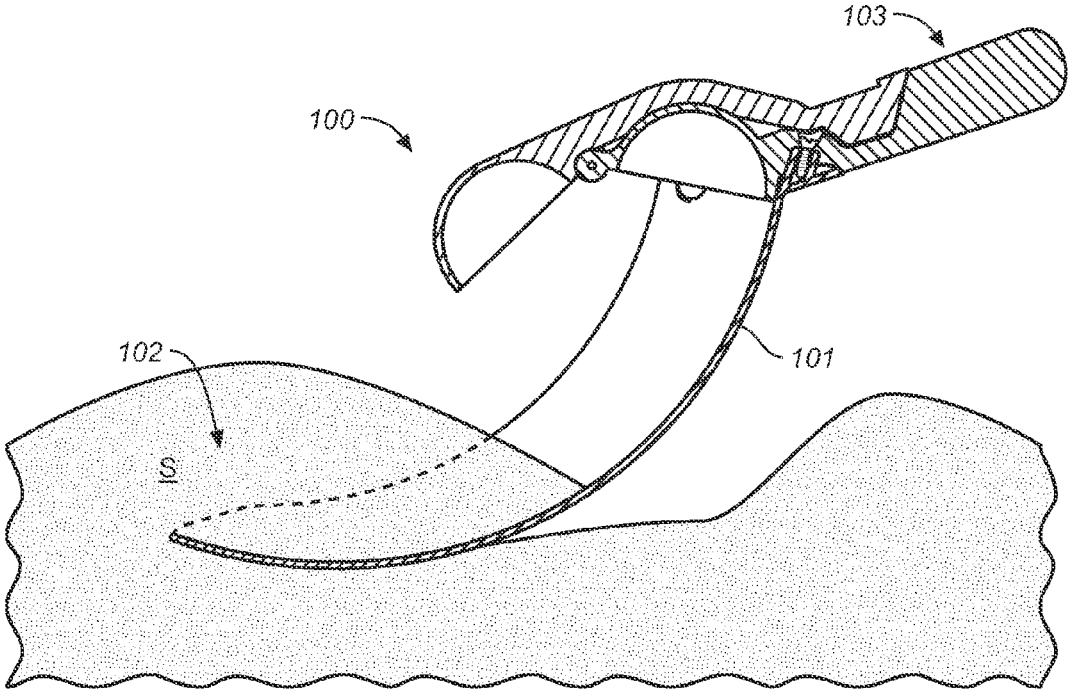
FIGS. 8A-G are side views illustrating a method of using a snowball forming and launching device, where
Figure 8B:
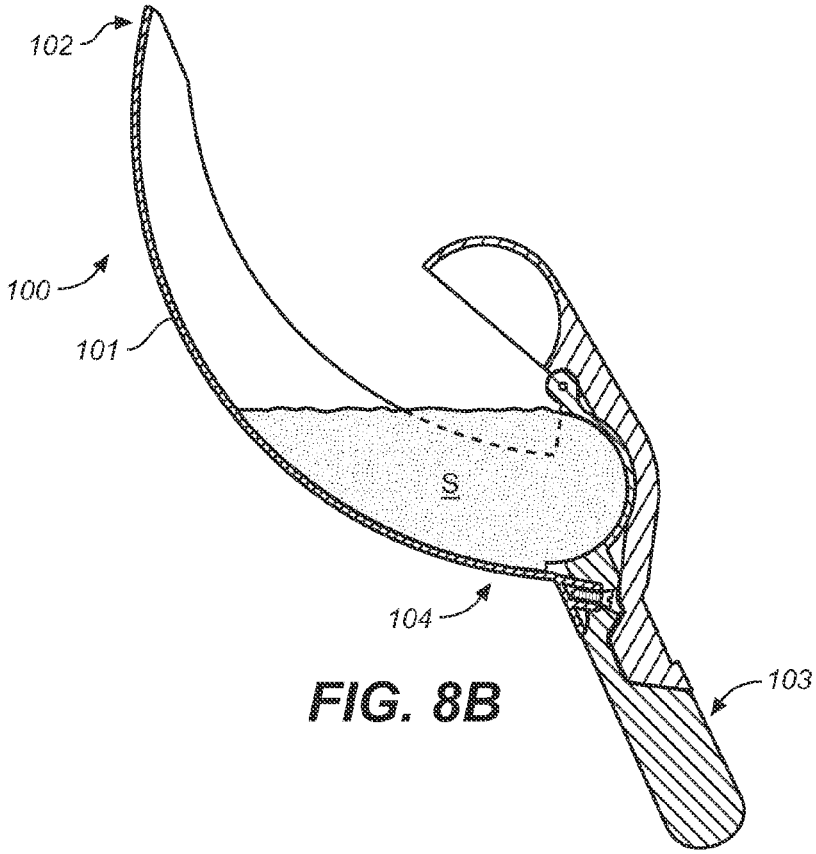
Figure 8C:
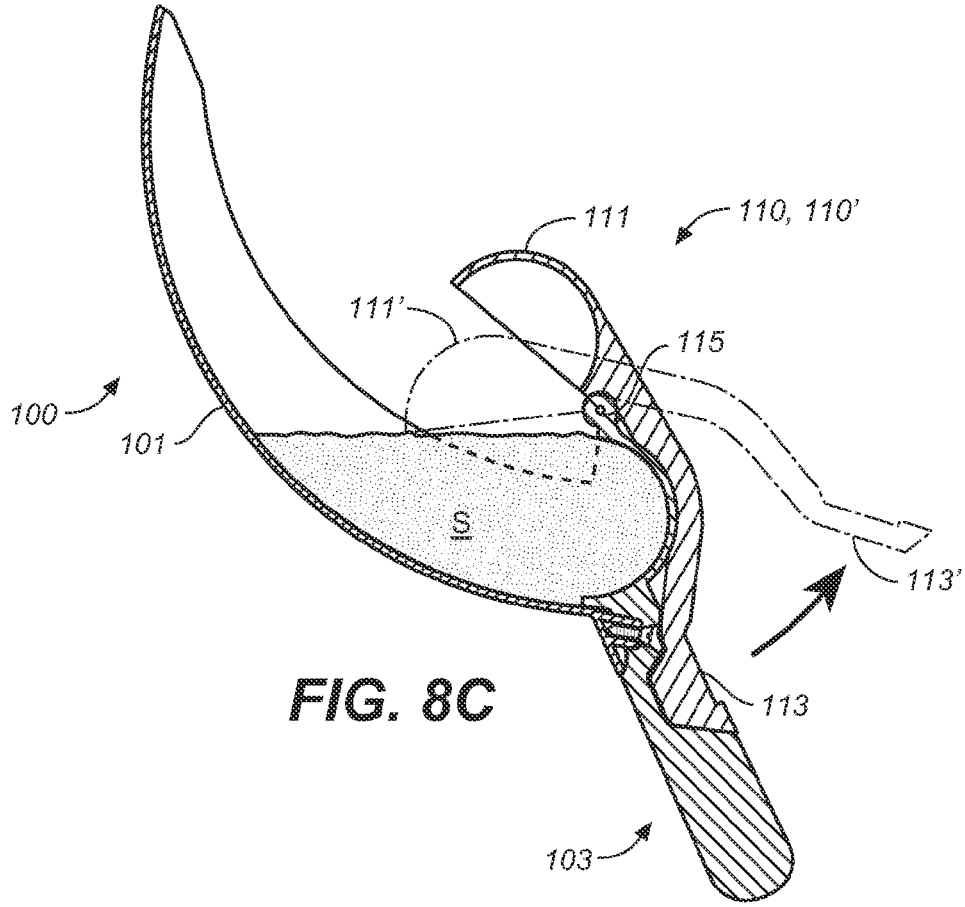
Figure 8D:
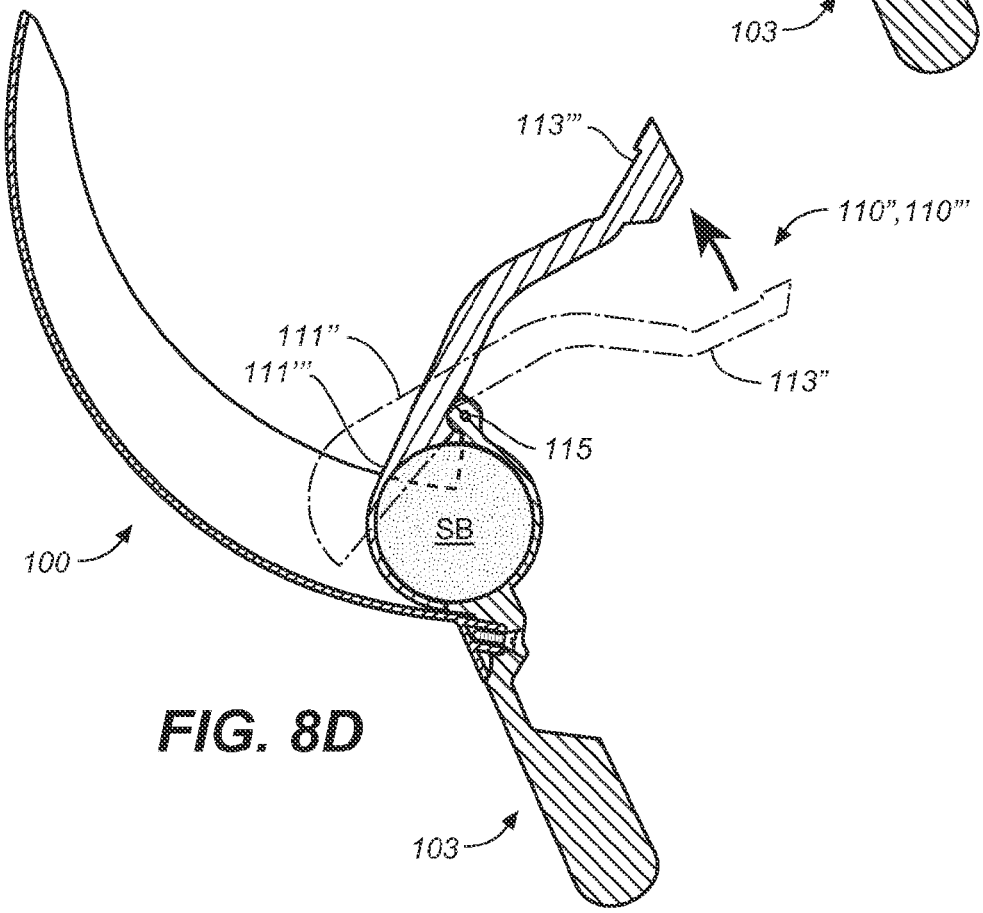
Figure 8G:
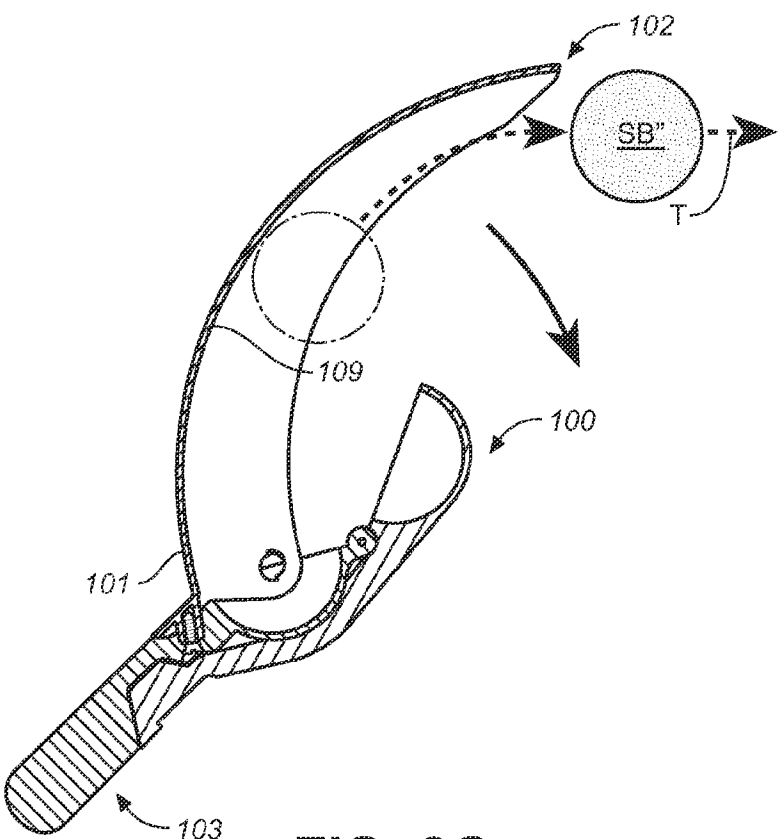
Figure 8F:
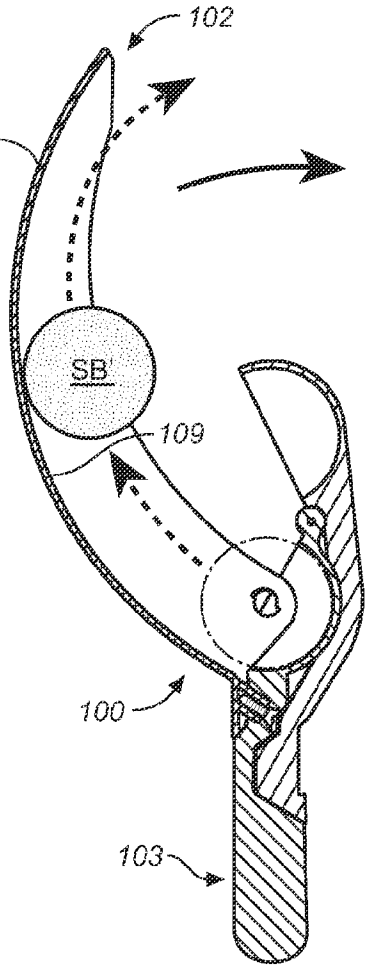
Figure 8E:
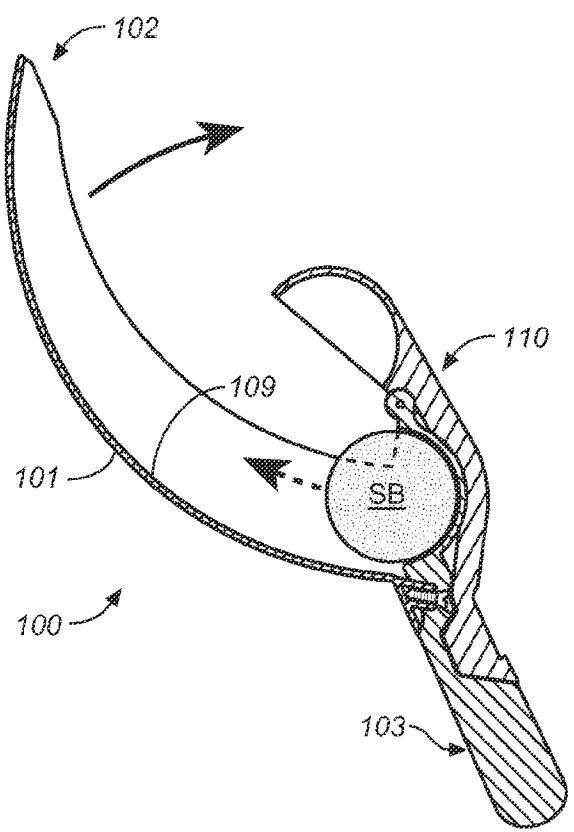

More specifically, FIGS. 8A-8G are side views illustrating a method of using device 100, where FIG. 8A illustrates the shoveling of snow into the device; FIG. 8B illustrates scooping snow into the device, FIGS. 8C and 8D illustrate consecutive positions of the device during the forming a snowball, and FIGS. 8E, 8F, and 8G illustrate consecutive positions of the devices during the launching of a snowball. It may be preferable for a user (not shown) to grasp handle 103 while manipulating device 100 though the steps of FIGS. 8A-8G.

As shown in FIG. 8A, distal end 102 of device 100 may be inserted into snow S and pushed along the snow to collect snow into channel 101. Next, as shown in FIG. 8B, device 100 may be rotated to direct the collected snow to channel proximal end 104.

FIGS. 8C and 8D illustrate the formation of a snowball. Specifically, FIG. 8C shows the collected snow S in a device 100 in an open press configuration (similar to that of FIG. 1), and indicated as portion 110 and having the associated lever 113 and mold 111, and a first intermediate configuration, indicated as portion 110' and having the associated lever 113' and mold 111'. The movement may be affected, for example by a user (not shown) holding handle 103 in one hand and lever 113 in the other hand, and rotating portion 110 about hinge 115. As mold 111 contacts snow S, a portion of the snow is gathered by the press.

FIG. 8D shows a second intermediate position, indicated as press 110" and having the associated handle 113" and mold 111", and a closed press position, indicated as press 110''' and having the associated handle 113''' and mold 111'''. The snow is further gathered and is pressed between molds 105 and 111 to form a snowball SB. Any snow S not formed into snowball SB is excess material, which is not shown, and which may remain in channel 101 or may be disposed of by shaking or turning device 100.

With a snowball thus formed, device 100 may be returned to the open position of FIG. 1. Alternatively, a snowball otherwise formed may be placed within mold 111. FIGS. 8E through 8G illustrate one method of launching a snowball SB. In each of FIGS. 8E-8G, a user grasps handle 113 and moves distal end 102 in an arcing motion, as indicated by the solid arrows. Thus, for example a user may rotate their arm through a throwing motion. As shown in FIGS. 8E-8G, his motion causes the snowball to move along channel 101, as indicate by the dashed arrows. Thus, for example, FIGS. 8E-8G show the snowball moving along bottom 109 of channel 101 from position SB' in FIG. 8E, to SB" in FIG. 8F, finally leaving channel 101 at position SB" with a trajectory Tin FIG. 8G. This method of throwing is similar to the method used in the game of Jai Alai.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

I claim:

1. A device for manipulating snow, said device comprising:
a handle;
a mold; and
an elongated portion having
a proximal portion near an opening of said mold, and a distal portion;
where said elongated portion has a longitudinal axis extending from said proximal portion to said distal portion; said longitudinal axis of the elongated portion is curved; and said proximal end forms an angle with a longitudinal axis of said handle of from approximately 45 degrees to approximately 60 degrees.

2. The device of claim 1, where said distal end forms an angle with a longitudinal axis of said handle of from approximately 40 degrees to approximately 55 degrees.

3. The device of claim 1, where the length of said elongated portion is from approximately 300 mm to approximately 700 mm.

4. The device of claim 1, where said mold includes an approximately spherical cavity, such that snow placed in said mold forms a snowball.

5. The device of claim 4, where said cavity has a diameter from approximately 30 mm to approximately 140 mm.

6. The device of claim 1, where said proximal portion is sized to accept snow pressed in said mold.

7. The device of claim 1, where said mold includes a first mold and a second mold, where said first mold and said second mold are configured to accept and mold snow there between, where said first mold is fixedly attached to said handle, and where said second mold is hinged to said first mold.

8. The device of claim 1, where said elongated portion is configured to scoop snow and provide the scooped snow to said mold.

9. A device for manipulating snow, said device comprising:
a handle;
a mold hinged to said handle; and
an elongated portion having
a proximal portion near an opening of said mold, and
a distal portion;
where said elongated portion has a longitudinal axis extending from said proximal portion to said distal portion, and where said longitudinal axis is curved.

10. The device of claim 9, where said proximal end forms an angle with a longitudinal axis of said handle of from approximately 45 degrees to approximately 60 degrees.

11. The device of claim 10, where said proximal portion is sized to accept snow pressed in said mold.

12. The device of claim 9, where said distal end forms an angle with a longitudinal axis of said handle of from approximately 40 degrees to approximately 55 degrees.

13. The device of claim 9, where the length of said elongated portion is from approximately 300 mm to approximately 700 mm.

14. The device of claim 9, where said mold includes an approximately spherical cavity, such that snow placed in said mold forms a snowball.

15. The device of claim 14, where said cavity has a diameter from approximately 30 mm to approximately 140 mm.

16. The device of claim 9, where said elongated portion is configured to scoop snow and provide the scooped snow to said mold.

* * * * *